United States Patent [19]

Rahaim

[11] 4,104,742

[45] Aug. 8, 1978

[54] CONVERTIBLE GARMENT

[76] Inventor: Sarah E. Rahaim, 3300 Atlantic Blvd., Jacksonville, Fla. 32207

[21] Appl. No.: 758,929

[22] Filed: Jan. 13, 1977

[51] Int. Cl.[2] ..... A41D 1/14

[52] U.S. Cl. ..... 2/213; 2/227; 2/DIG. 6

[58] Field of Search ..... 2/213, 212, 86, 72, 2/73, 227, DIG. 6, 211

[56] References Cited

U.S. PATENT DOCUMENTS

| | | | |
|---|---|---|---|
| 1,250,004 | 12/1917 | Philip | 2/213 |
| 1,629,561 | 5/1927 | Welstatter | 2/72 X |
| 2,689,958 | 9/1954 | Gray | 2/227 |
| 3,154,082 | 10/1964 | Cape | 2/DIG. 6 |

FOREIGN PATENT DOCUMENTS

| | | | |
|---|---|---|---|
| 1,374,231 | 8/1964 | France | 2/DIG. 6 |

OTHER PUBLICATIONS

"Living is Easier with VELCRO Closures;" Received in PTO, Sep. 1972.

Touch and Close Baby Clothes; Received in PTO, Sep. 1972.

*Primary Examiner*—H. Hampton Hunter

*Attorney, Agent, or Firm*—George H. Baldwin; Arthur G. Yeager

[57] ABSTRACT

A convertible short pants and skirt garment is disclosed including releaseable fastening hook and pile fabric means connecting the front and back portions to form a crotch whereby the garment is a pair of pants with depending legs. Each of the front and back bottom edge portions is folded inwardly with the fastening means in nonclosing condition thereby respectively forming inwardly directed front and back pleats whereby the garment is a skirt. The hook portion of the fastening means is located on the outer garment surface so that when it is folded onto itself, it adheres to partially close the back pleat in the skirt.

The legs can be extended to form longer pants and either the releaseable fastening means can extend to the lower ends of the pants or can terminate generally above the knee portions.

6 Claims, 13 Drawing Figures

FIG. 1
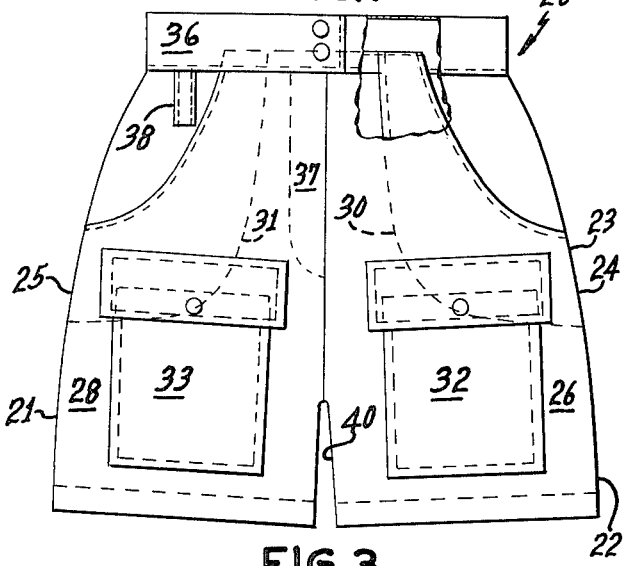
FIG. 2
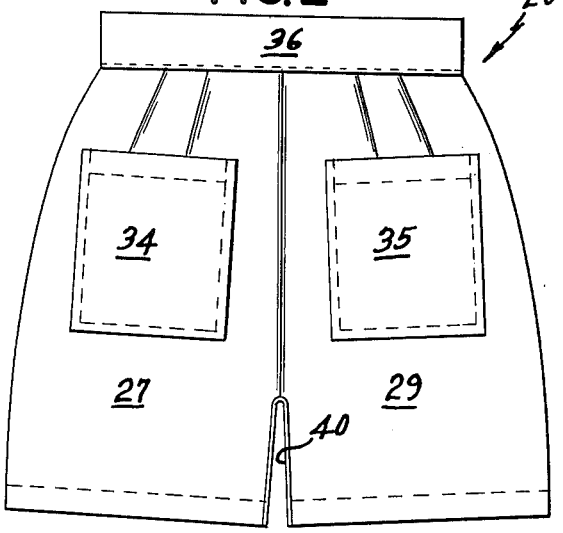
FIG. 3
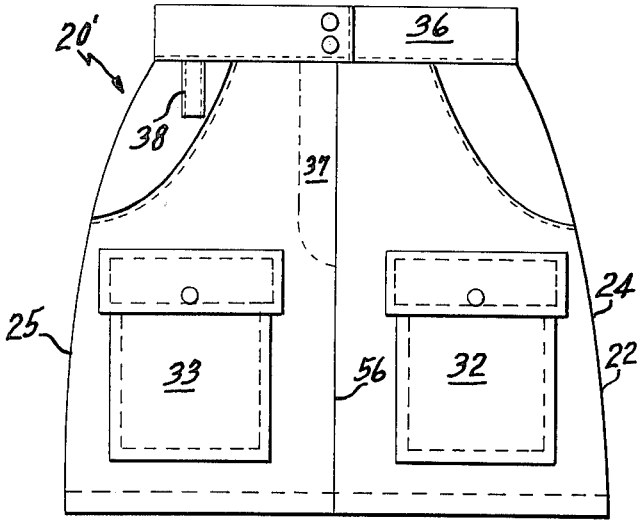
FIG. 4
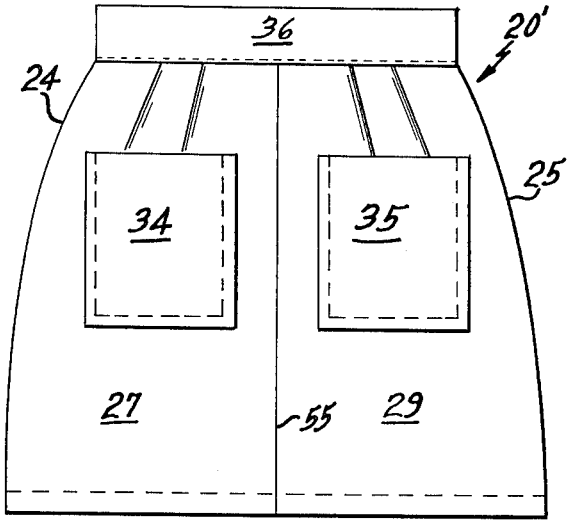
FIG. 5
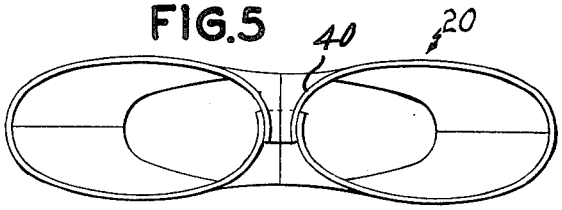
FIG. 7
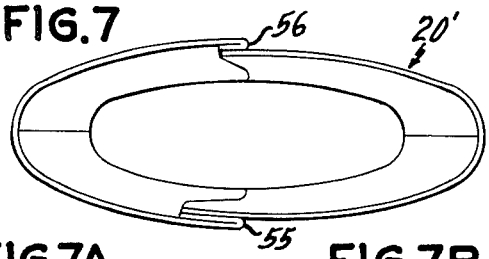
FIG. 6
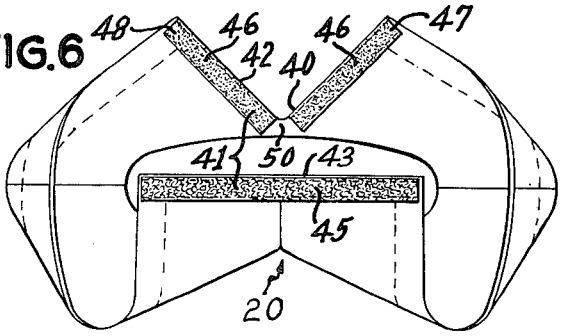
FIG. 7A
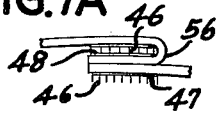
FIG. 7B
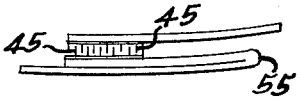
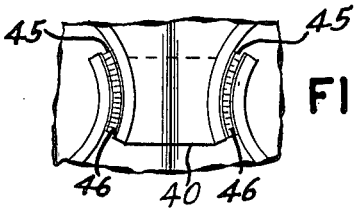
FIG. 5A

CONVERTIBLE GARMENT

BACKGROUND OF THE INVENTION

1. Field of the Invention

This invention relates to garments and more particularly concerns convertible garments as feminine attire. Furthermore, such garment is convertible from a pair of short pants into a skirt and vice versa with a minimum of effort and without additional connectors or the like. Also, the legs may in another embodiment extend into long pants with a portion of the legs generally below the knees being closed or opened.

2. Description of the Prior Art

Various convertible garments have been suggested by the prior art such as those found in the preliminary novelty search; namely, U.S. Pat. Nos. 330,920; 1,113,998; 1,250,004; 1,297,932; 1,329,029; 1,629,561 and; 2,368,189.

There are various deficiencies in the art as related to the present invention. There is no showing in the prior art of a convertible short pants and skirt garment nor of the use of hook and pile fasteners for connecting the crotch, etc., as will be more fully understood by reference to the following disclosure.

SUMMARY OF THE INVENTION

A normal pants garment includes a pair of leg portions, and a crotch portion which connects a front edge portion to a back edge portion. In accord with this invention releaseable fastening means is provided for the connection of the crotch portion, such means comprising an elongated loop or hook fabric means extending along and on the outer surface of the back portion, and an elongated pile fabric means extending along and on the inner surface of the front edge portion. The hook and pile means are in face to face adhering contact for substantially sealingly connecting the front and back portions and forming the crotch portion of the improved pants garment.

Other aspects of the invention include the provision of the hook means and pile means extending substantially the full length of the leg portions. The pile means is formed of two longitudinally spaced apart and substantially equal lengths of pile fabric members with the front edge portion when flattened being substantially V-shaped and the back edge portion being substantially straight.

The hook means is folded onto itself to partially connect same in an inwardly directed back pleat; and the front edge portion is foldable inwardly to form a front pleat, thereby converting the garment from a pair of pants to a skirt. The leg portions may extend below the crotch portion with such crotch portion only being releasably connected by the releasable fastening means.

A general object of this invention is to provide an improved garment.

A particular object is the provision of an improved garment convertible from a pair of pants into a skirt.

Another particular object is to provide an improved pants garment with a releaseably connected crotch closure.

A specific object is the provision of a skirt with inwardly directed pleats which converts to a pair of short pants with the crotch substantially completely closed.

Other specific objects are to provide a convertible garment which is economically constructed, durable in use, comfortable when worn as a skirt or a pair of pants, and readily converted from one to another with a minimum of effort and without additional fasteners or the like.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

FIG. 1 is a front elevational view of the outside of the garment formed into a pair of short pants in accord with the present invention;

FIG. 2 is a back elevational view of the pants garment of FIG. 1;

FIG. 3 is a front elevational view similar to FIG. 1 and showing the garment formed into a skirt in accord with this invention;

FIG. 4 is a back elevational view of the skirt garment of FIG. 3;

FIG. 5 is a bottom view of the pants garment of FIG. 1 showing the crotch closure;

FIG. 5A is an enlarged partial view similar to FIG. 5,

FIG. 6 is a bottom view of the pants garment with the crotch in disconnected condition and the front crotch edge portions flattened and spread away;

FIG. 7 is a bottom view of the skirt garment of FIGS. 3 and 4;

FIG. 7A is an enlarged view of the front edge portions in the form of an inwardly directed pleat;

FIG. 7B is an enlarged view of the rear edge portion in the form of an inward pleat with the connection portions in face to face contact and in a partial connecting condition to maintain such pleat closed;

DESCRIPTION OF THE PREFERRED EMBODIMENTS

Figure 8:
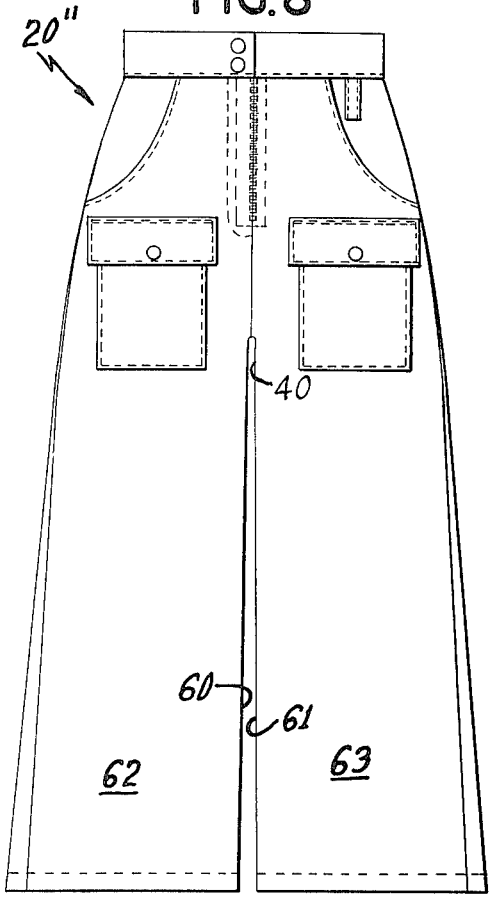
FIG. 8 is a front elevational view of the garment in accordance with another embodiment of the present invention and showing the garment as a pair of long pants.
Figure 9:
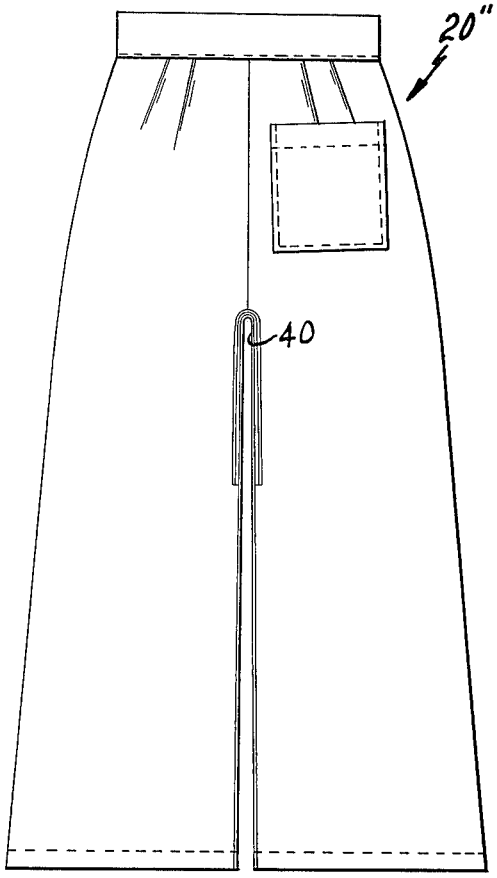
FIG. 9 is a back elevational view of the garment of FIG. 8.
Figure 10:
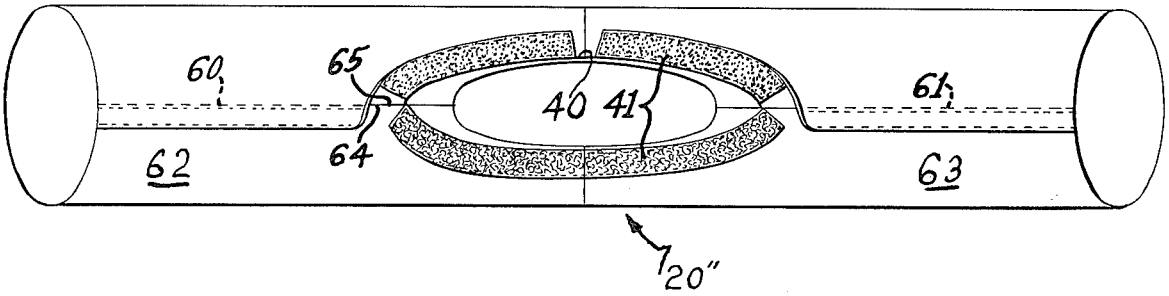
FIG. 10 is a diagrammatic view of the garment of FIG. 8 with the legs spread apart and the recloseable crotch portion being shown in open condition.

Referring now more particularly to the drawings, the garment, generally designated by numeral 20 in FIGS. 1 and 2, is illustrated as a pair of short pants having leg portions 21 and 22 depending from the hip portion 23. The pants 20 have side seams 24 and 25 respectively connecting left front and back panels 26 and 27 and right front and back panels 28 and 29. The construction of the front side pockets 30 and 31, front flap pockets 32 and 33, back pockets 34 and 35, waistband 36, zippered fly 37, rope loop 38, as well as the various fasteners connected thereto are well known.

The crotch portion 40 is best illustrated in FIGS. 5 and 6 and comprises releasable fastening means 41 connecting a front edge portion 42 of the garment 20 to the back edge portion 43 thereof, such fastening means being formed of commerically obtainable hook-pile fabric, such as is known as Velcro fabric which is described in U.S. Pat. Nos. 2,717,437 and 3,009,235. The hook fabric portion 45 normally contains resilient nylon bristles or hooks extending from the surface of a backing sheet, and the pile fabric portion 46 contains closely spaced and randomly oriented fuzzy pile extending from the surface of a backing sheet. The hooks of portion 45 penetrate into and lock onto the fuzzy pile of portion 46, and a pulling apart force is required to separate the hook and pile portions, i.e., the hooks are yieldable to cause them to become released from the pile when a sufficient separating force is applied therebetween.

In accord with an aspect of this invention the hook portion 45 is attached along the back edge portion 43 and pile portion 46, consisting of a pair of spaced portions 47 and 48, are attached along the front edge portion 42, as clearly shown in FIG. 6. When portions 47 and 48 are intermeshed with portion 45, the garment is in the form of pants with the edge portions 42 and 43 being connected and forming a crotch portion of the pants, as illustrated specifically in FIGS. 1, 2, 5 and 6 with FIG. 5A being exploded to show the specific details thereof.

It is important that the pile portion 46 be spaced apart and forming an area 50 to accommodate the bulk of the material at the crotch intersection, particularly due to the doubling of the hook portion 45, turned in edges of the garment fabric and the like. Furthermore, the pile portion 46 is seen to be on the inside of the garment while the hook portion 45 is on the outside of the garment whereby any noticeable gapping therebetween is minimized due to the gap being viewable from the rear which is partially obfuscated by the protruding buttocks of the female wearer of the garment.

The pants garment 20 is transformed into the skirt garment 20' with all of the parts thereof being identical, and only the material differences therebetween will be described hereinafter. Obviously the crotch portion 40 no longer exists in the skirt form of garment. Rather, the hook and pile portions 45, 46 are separated, the hook portion 45 is folded onto itself, as seen in FIG. 7 and 7B, to partially intermesh and close the inwardly directed back pleat 55, and the pile portions 47 and 48 are folded outwardly with respect to each other, but inwardly of the garment, to form an inwardly directed front pleat 56.

In accord with an aspect of this invention the facing and intermeshing relation of the hook portion 45 serves to inhibit the opening of the inwardly directed back pleat 55, while simultaneously avoiding contact between the rough and scratchy hooks with the back of the thighs of the female wearer of the skirt garment. The amount of garment fabric forming back pleat 55 is larger than the fabric forming the front pleat 56 and such intermeshing relation of the overlapped hook portion 45 serves to provide a pleasing overall line and look from the rear of the skirt garment. As to the fuzzy or pile portion 46, particularly the portion 47 exposed inwardly toward the wearer of the skirt garment, the occassional engagement, during walking, between the front of the thighs and such pile portion 47 is not irritable or uncomfortable.

While the front pleat 56 is shown as opening from the right side of the garment 20', as viewed in FIGS. 7 and 7A, and back pleat 55 also opens from the right side, as viewed in FIGS. 7 and 7B, it is to be understood that either or both pleats 55 and 56 may open from the left side of the garment 20'. The positioning and opening of the pleats 55 and 56 will be somewhat dependent on the nature of the fabrics, the sewing of the seams, and Velcro, etc., and any pressing of the garment.

The long pants garment 20'', in accord with this invention, is substantially similar to the garment 20, except that the inseams 60 and 61 of the leg portions 62 and 63 are formed of overlapped edge portions 64 and 65 that are double stitched below the openable and closeable crotch portion fastening means 41.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

I claim:

1. In an outer short pants and convertible skirt garment having leg portions and a crotch portion connecting a front edge portion to a back edge portion, the improvement comprising releaseable fastening means connecting said crotch portion, said means including an elongated hook fabric means extending along said back edge portion, said fastening means further including an elongated pile fabric means extending along said front edge portion, said hook means being connected to the outer surface of said garment and said pile means being connected to the inner surface of said garment, said hook means and pile means being in face to face adhering contact for substantially sealingly connecting said front and back portions and forming said crotch portion of said pants garment, said hook means being folded onto itself to partially connect same in an inwardly directed back pleat and said front edge portion being folded inwardly to form a front pleat, whereby said pants garment is selectively convertedinto a skirt with inwardly directed front and back pleats.

2. In the garment as defined in claim 1 wherein said hook means and pile means extend substantially the full length of said leg portions.

3. In the garment as defined in claim 1 wherein said pile means is formed of two longitudinally spaced apart and substantially equal lengths of pile fabric members.

4. In the garment as defined in claim 1 wherein said back edge portion when flattened is substantially straight and said front edge portion when flattened is substantially V-shaped.

5. In a convertible outer fitted pants and skirt fabric garment having a front portion with spaced side edge portions and a bottom edge portion and a back portion with spaced side edge portions and bottom edge portion, said side edge portions of said front and back portions being connected to form opposite side seams of said garment, the improvement comprising releaseable fastening means connecting said front and back bottom edge portions to form a crotch whereby said garment is a pair of fitted pants with depending legs, and each of said front and back bottom edge portions being folded inwardly with said fastening means in released condition thereby respectively forming inwardly directed front and back pleats whereby said garment is converted into a skirt, the bottom edges of the fabric in said pleats being substantially horizontally disposed in general alignment with the hem of the garment when the same is worn as a skirt.

6. In the garment as defined in claim 5 wherein said releasable fastening means includes an elongated hook member disposed along said back edge portion on the outer surface of said garment and an elongated pile member disposed along said front edge portion on the inner surface of said garment, said hook member being folded onto itself to partially close said back pleat in the skirt condition of said garment.

* * * * *